US008840002B2

(12) United States Patent
Ito et al.

(10) Patent No.: US 8,840,002 B2
(45) Date of Patent: Sep. 23, 2014

(54) FASTENER-DRIVING TOOL

(75) Inventors: Yutaka Ito, Hitachinaka (JP); Hiroyuki Oda, Hitachinaka (JP); Yoshihiro Nakano, Hitachinaka (JP)

(73) Assignee: Hitachi Koki Co., Ltd., Minato-ku, Tokyo (JP)

( * ) Notice: Subject to any disclaimer, the term of this patent is extended or adjusted under 35 U.S.C. 154(b) by 269 days.

(21) Appl. No.: 12/827,976

(22) Filed: Jun. 30, 2010

(65) Prior Publication Data

US 2011/0000949 A1 Jan. 6, 2011

(30) Foreign Application Priority Data

Jul. 1, 2009 (JP) ..... 2009-156512
Sep. 28, 2009 (JP) ..... 2009-223410

(51) Int. Cl.
*B27F 7/00* (2006.01)
*B25C 5/00* (2006.01)
*B25C 1/06* (2006.01)

(52) U.S. Cl.
CPC ..... *B25C 1/06* (2013.01)
USPC ..... 227/138

(58) Field of Classification Search
USPC ..... 227/138, 175.1–182.1, 8, 51, 107; 173/128, 211
See application file for complete search history.

(56) References Cited

U.S. PATENT DOCUMENTS 4,562,324 A * 12/1985 Hall et al. ..... 200/260
5,098,004 A * 3/1992 Kerrigan ..... 227/134
5,118,023 A * 6/1992 Fushiya et al. ..... 227/8
5,182,973 A * 2/1993 Martindell ..... 81/429
5,407,018 A * 4/1995 Henry ..... 173/211
5,685,473 A 11/1997 Shkolnikov et al.
5,799,855 A * 9/1998 Veoukas et al. ..... 227/10
5,897,043 A * 4/1999 Veoukas et al. ..... 227/10
5,911,428 A * 6/1999 Ueda et al. ..... 280/276
6,186,386 B1 2/2001 Canlas et al.
6,695,192 B1 * 2/2004 Kwok ..... 227/8

(Continued)

FOREIGN PATENT DOCUMENTS

JP H07-115307 A 11/1990
JP H04-122581 A 4/1992
JP 10-058349 A 3/1998
JP 2008-238291 A 10/2008

OTHER PUBLICATIONS

Japan Patent Office office action for JPO patent application JP2009-156512 (Jul. 22, 2013).

*Primary Examiner* — Robert Long

(74) *Attorney, Agent, or Firm* — Kilpatrick, Townsend & Stockton LLP

(57) ABSTRACT

An adjuster has a cylindrical shape and is rotatably supported in a housing of a fastener-driving tool about an axis parallel to one direction. The adjuster has an outer circumferential surface provided with one of a first recessed portion and a first protruding portion. A bumper is movable in the one direction and another direction opposite the one direction according to a rotation of the adjuster. An urging member has one of a second recessed portion and a second protruding portion. One of the second recessed portion and the second protruding portion is constantly in contact with the outer circumferential surface and is engaged with the one of the first recessed portion and the first protruding portion.

11 Claims, 9 Drawing Sheets

(56) References Cited

U.S. PATENT DOCUMENTS

| | | | | |
|---|---|---|---|---|
| 6,883,696 | B1 | 4/2005 | Steinbrunner et al. | |
| 7,832,610 | B2 | 11/2010 | Tanimoto et al. | |
| 7,938,305 | B2 * | 5/2011 | Simonelli et al. | 227/132 |
| 8,490,852 | B2 * | 7/2013 | Viola | 227/179.1 |
| 2005/0284649 | A1 * | 12/2005 | Sabates et al. | 173/212 |
| 2006/0231811 | A1 * | 10/2006 | Koenecke | 254/228 |
| 2008/0041914 | A1 * | 2/2008 | Simonelli et al. | 227/132 |
| 2009/0236387 | A1 * | 9/2009 | Simonelli et al. | 227/8 |

* cited by examiner

FASTENER-DRIVING TOOL

CROSS REFERENCE TO RELATED APPLICATION

This application claims priority from Japanese Patent Application Nos. 2009-156512 filed Jul. 1, 2009 and 2009-223410 filed Sep. 28, 2009. The entire contents of each of these priority applications is incorporated herein by reference.

TECHNICAL FIELD

The present invention relates to a fastener-driving tool.

BACKGROUND

Japanese Patent Application Publication No. H07-115307 and Japanese Patent Application Publication No. H04-122581 disclose a battery-powered fastener-driving tool. The fastener-driving tool uses the driving force of a motor to raise a plunger, compressing a coil spring. When the coil spring is released, the plunger accelerates to drive a fastener.

This fastener-driving tool uses the rotation of a motor to compress the coil spring, storing the energy of the spring. When the coil spring is released, the plunger and a driver blade mounted thereon are rapidly accelerated, and the driver blade strikes a fastener. After impact, the plunger collides with a bumper that absorbs the excess energy, halting the plunger and driver blade. During this operation, the driver blade ejects a prescribed distance out through an opening in the main body of the fastener-driving tool to drive the fastener into a workpiece.

Here, there is a need for the fastener-driving tool to be capable of adjusting the depth at which the fastener is driven into the workpiece, hereinafter referred to as the "driving depth," because the fastener-driving tool may be used on workpieces formed of various materials. Depending on the material composition of the workpiece, the fastener may not be completely embedded in the workpiece or may be driven too far into the workpiece if the fastener-driving tool strikes the workpiece with a fixed force of impact. Therefore, some conventional fastener-driving tools have been provided with a mechanism for adjusting the driving depth.

Japanese Patent Application Publication No. H04-122581 discloses a mechanism for shifting the bumper in the direction that the fastener is driven (hereinafter "driving direction") or in the direction opposite the driving direction. This fastener-driving tool is provided with a bumper holder for supporting the bumper in the housing. The bumper holder is capable of moving integrally with the bumper in the driving direction or the direction opposite the driving direction. A rotatable adjuster is provided in the housing. A threaded part is formed on part of the bumper holder, and another threaded part is formed on a portion of the adjuster and is screwed together with the threaded part of the bumper holder. A peripheral portion of the adjuster is exposed outside of the housing through a through-hole formed in the housing.

The user can adjust the positions of the bumper and bumper holder in either the driving direction or the direction opposite the driving direction by rotating the adjuster. When the user adjusts the position of the bumper in the direction opposite the driving direction, the plunger more quickly impacts the bumper during a driving operation, reducing the driving depth. Conversely, when the user adjusts the position of the bumper in the driving direction, the plunger impacts the bumper later during a driving operation, increasing the driving depth.

This fastener-driving tool is also provided with an anti-rotating mechanism to prevent the adjuster from unexpectedly rotating when there is no need to rotate the adjuster. Specifically, a plurality of recessed parts is formed circularly in one axial endface of the adjuster, while a pin whose head part can contact one of the recessed parts is urged toward the adjuster endface by a spring. With this construction, the pinhead engages in one of the recessed part when the adjuster is rotated, producing a clicking sensation and preventing the adjuster from rotating in a smooth, continuous motion. Thus, the engagement of the pin in one of the recessed parts prevents the adjuster from rotating unexpectedly.

SUMMARY

However, in the fastener-driving tool described in Japanese Patent Application Publication No. H04-122581, the bumper, bumper holder, and anti-rotating mechanism are all disposed on one axial end of the adjuster. Further, the head of the pin constituting the anti-rotating mechanism contact the axial endface of the adjuster. Consequently, when the adjuster collides with the bumper, the pinhead collides with the endface of the adjuster, the impact force can damage the pinhead.

In addition, if an adjuster is annular in shape, with a threaded part formed on an inner circumferential surface of the adjuster, this threaded part is engaged in and covers a threaded part on a bumper holder. Thus, during a driving operation, an impact load is applied to the threaded parts of the bumper holder and adjuster. Consequently, the bumper holder tends to rotate relative to the adjuster along the slope of the threaded parts, moving in the driving direction. When the bumper holder and adjuster are in contact with each other (i.e., when the bumper holder is in its lowest position relative to the adjuster), the impact load during a driving operation may further rotate and tighten the bumper holder. When such tightening occurs, the torque of the adjuster is abruptly increased due to the spring constant of its material and, in some cases, the user may have difficulty rotating the adjuster.

Therefore, it is an object of the present invention to provide a fastener-driving tool having an anti-rotating mechanism that is not damaged when the plunger impacts the bumper. It is another object of the present invention to provide a fastener-driving tool that improves operability by preventing changes in the torque of the adjuster during a driving operation.

In order to attain the above and other objects, the present invention provides a fastener-driving tool including a housing, a motor provided on the housing, a blade, a plunger, a bumper, an adjuster, and an urging member. The blade is provided in the housing and impacts a fastener in one direction. The plunger is provided in the housing and is movable together with the blade in the one direction and another direction opposite the one direction. The bumper is movable in the one direction and the another direction. The plunger collides the bumper when the blade impacts the fastener. The adjuster has a cylindrical shape and is rotatably supported in the housing about an axis parallel to the one direction. The adjuster has an outer circumferential surface provided with one of a first recessed portion and a first protruding portion. The bumper is movable in the one direction and the another direction according to a rotation of the adjuster. The urging member is provided in the housing and has one of a second recessed portion and a second protruding portion. One of the second recessed portion and the second protruding portion is constantly in contact with the outer circumferential surface and is engaged with the one of the first recessed portion and the first protruding portion.

Another aspect of the present invention, there is provided a fastener-driving tool including a housing, a blade, a plunger, a bumper, a bumper holder, a threaded member, and an elastic member. The blade is provided in the housing and impacts a fastener in one direction. The plunger is provided in the housing and is movable together with the blade in the one direction and another direction opposite the one direction. The bumper is disposed to overlap with the plunger in the one direction. The plunger collides the bumper when the blade impacts the fastener. The bumper holder has a receiving surface for receiving the bumper and a first surface positioned on an opposite side of the receiving surface from the bumper. The bumper holder is provided with a first threaded part positioned on the opposite side of the receiving surface from the bumper. The threaded member is rotatably supported on the housing and is provided with a second threaded part threadingly engaged with the first threaded part. The threaded member has a second surface disposed in opposition to the first surface. The bumper holder is movable in the one direction and the another direction according to a rotation of the threaded member. The elastic member is interposed between the first surface and the second surface.

DETAILED DESCRIPTION

Figure 1:
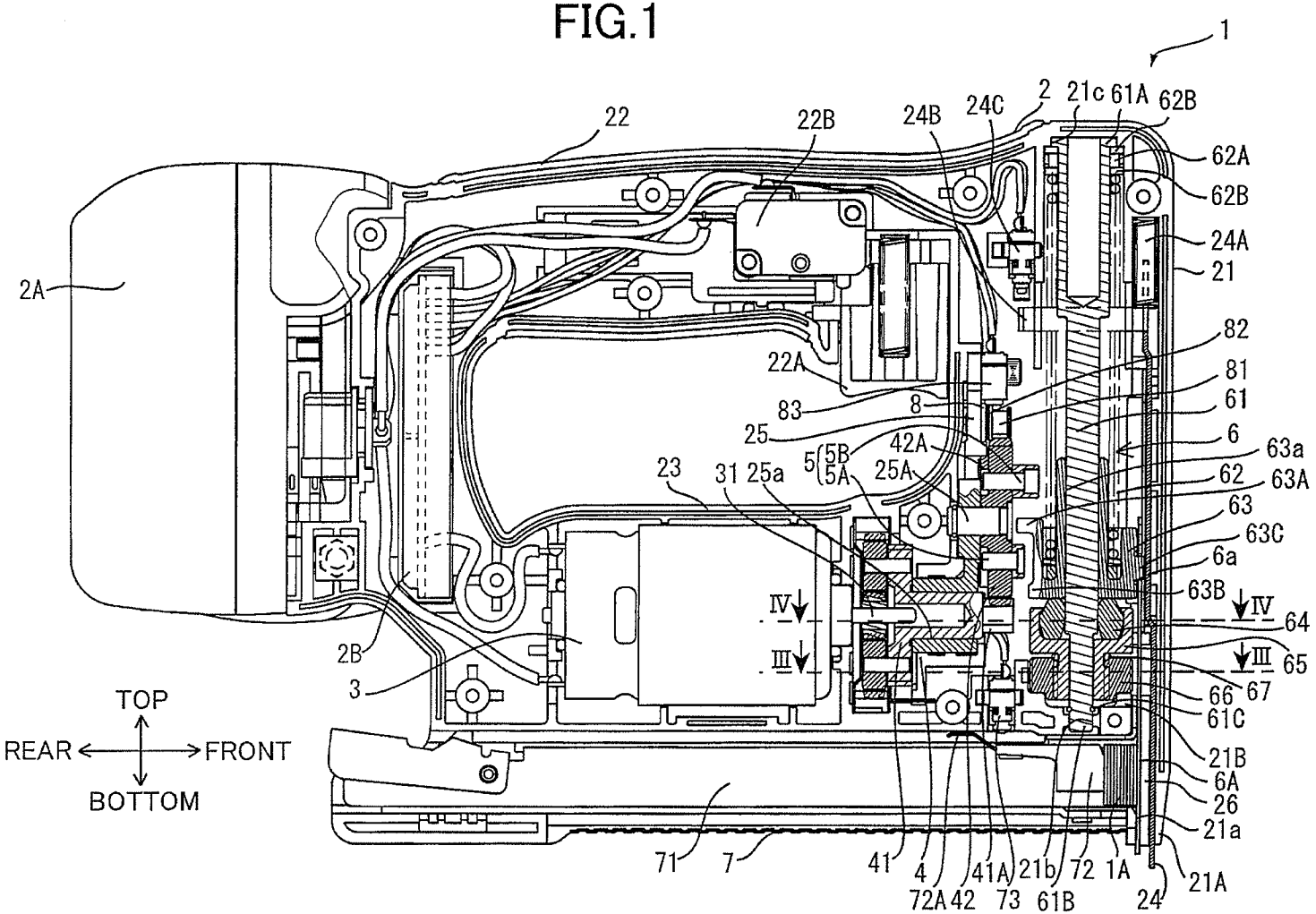
FIG. 1 is a side cross-sectional view of a nail-driving tool according to an embodiment of the present invention.

Next, a fastener-driving tool according to an embodiment of the present invention will be described with reference to FIGS. 1 through 8. The fastener-driving tool shown in FIG. 1 is an electrically powered nail-driving tool 1 used to drive staples 1A into a workpiece, such as boards made of wood or gypsum. The nail-driving tool 1 primarily includes a housing 2 and, accommodated in the housing 2, a motor 3, a drive-reducing mechanism 4, a compression mechanism 5, a coil spring unit 6, a magazine 7, and an angular position detecting mechanism 8.

In the following description, a direction in which a plunger 63 (described later) moves is defined as the vertical direction; a direction in which a coil spring 62 (described later) of the coil spring unit 6 urges the plunger 63 to strike the staple 1A will be defined as the downward direction (hereinafter also referred to as the "driving direction"), while the opposite direction will be defined as the upward direction (hereinafter also referred to as the direction opposite the driving direction); and a direction in which a handle 22 (described later) extends from the side of the nail-driving tool 1 (a main body 21) accommodating the plunger 63 (leftward in FIG. 1) will be referred to as the rearward direction, while the opposite direction will be defined as the forward direction.

The housing 2 is formed of a resin, such as nylon or polycarbonate. The housing 2 is chiefly configured of the main body 21 primarily housing the compression mechanism 5, coil spring unit 6, and a blade guide 26; the handle 22 extending from the top portion of the main body 21 in a direction substantially orthogonal to the vertical direction; and a sub-body 23 extending from the bottom portion of the main body 21 substantially parallel to the handle 22 and primarily accommodating the drive-reducing mechanism 4.

A nose part 21A constitutes the bottom end of the main body 21 and protrudes downward therefrom. The blade guide 26 is embedded in the nose part 21A and serves to hold a driver blade 6A described later. The rear surface of the blade guide 26 in the nose part 21A defines part of an ejection hole 21*a*. The ejection hole 21*a* penetrates the main body 21 to the position of the plunger 63. A cover plate (not shown) positioned on the front surface of the driver blade 6A is disposed above the blade guide 26. A receiving part 21B for receiving the coil spring unit 6 is formed in a lower inner portion of the main body 21 near the nose part 21A. A lower penetrating hole 21*b* is formed in a substantially central portion of the receiving part 21B. The lower penetrating hole 21*b* is open on the top, and the coil spring unit 6 is fitted therein.

An upper recess portion 21*c* is formed in the main body 21 above the coil spring unit 6, and the coil spring unit 6 is fitted therein.

Figure 3:
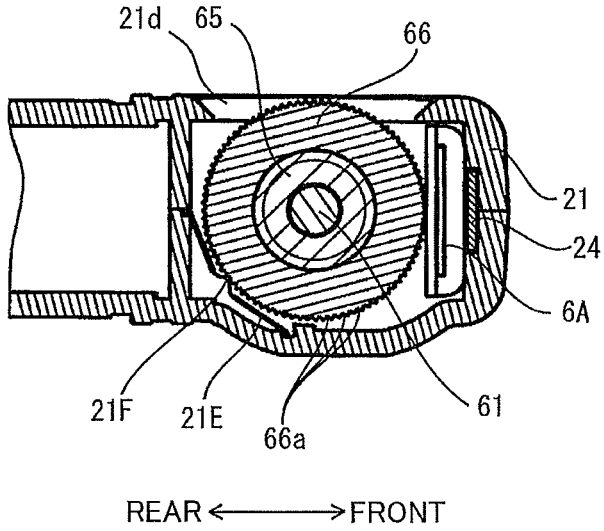
FIG. 3 is a cross-sectional view of an adjuster and surrounding region taken along the line III-III in FIG. 1.
Figure 4A:
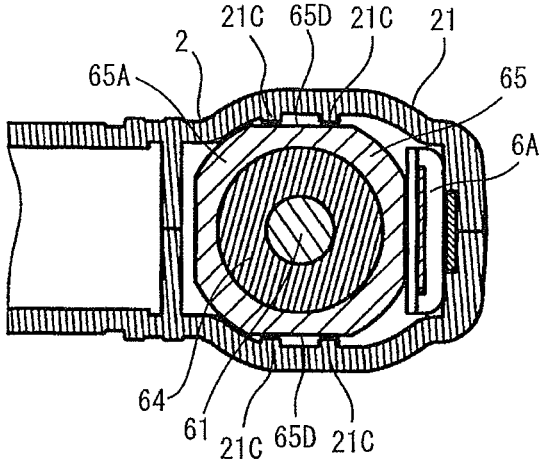
FIG. 4A is a cross-sectional view taken along the line IV-IV in FIG. 1 showing a bumper holder and the surrounding area prior to rotating the bumper holder.

As shown in FIG. 3, an opening 21*d* is formed in a side wall of the main body 21 at a position above the receiving part 21B. The opening 21*d* provides communication between the interior and exterior of the housing 2 so that a peripheral portion of an adjuster 66 described later is exposed therethrough. As shown in FIG. 4A, a pair of rails 21C extending vertically is provided on the inner surface of each of opposing side walls constituting the main body 21 at positions above the opening 21*d*. An urging member 21E is fixed to the inside of the housing 2 near the opening 21*d*. The urging member 21E is configured of a leaf spring. The urging member 21E is oriented so that its surface is parallel to the vertical and is bent so as to form a protruding portion 21F in the approximate longitudinal center of the urging member 21E. The protruding portion 21F extends vertically along the surface of the urging member 21E. The urging member 21E is formed of a material having a high degree of hardness, such as a stainless steel designed for springs and having a high hardness specification so as not to wear when sliding over the peripheral surface of the adjuster 66.

As shown in FIG. 1, a push lever 24 capable of moving vertically in relation to the main body 21 is disposed in the main body 21 on the front side of the coil spring unit 6. The lower end of the push lever 24 protrudes farther downward than the bottom end of the nose part 21A. When an user places the nose part 21A in contact with a workpiece, the push lever 24 is pushed in through the tip of the nose part 21A and retracts upward into the main body 21. An urging member 24A is disposed on the top end of the push lever 24 for urging the push lever 24 to protrude out from the tip of the nose part 21A. Accordingly, the push lever 24 constantly protrudes from the nose part 21A when not urged upward through contact with a workpiece.

The push lever 24 also has an arm part 24B that extends rearward while skirting the coil spring unit 6. A push switch 24C is disposed in the main body 21 above the arm part 24B for detecting upward movement of the push lever 24.

A gear holder 25 is disposed in the main body 21 to the rear of the coil spring unit 6 for holding a planetary gear mechanism 41 and a final gear 42 described later. The gear holder 25 includes a supporting shaft 25A for axially supporting the final gear 42. The supporting shaft 25A protrudes forward from the gear holder 25, with its axis oriented in the front-to-rear direction. A through-hole 25*a* penetrates the gear holder 25 below the supporting shaft 25A in the front-to-rear direction. The planetary gear mechanism 41 is inserted in the through-hole 25*a*.

A trigger 22A and a trigger switch 22B for controlling the motor 3 are disposed in the portion of the handle 22 that connects to the main body 21. A detachable battery 2A is disposed on the rear end of the handle 22. A power supply regulator 2B is provided in the handle 22 at a position near the battery 2A for controlling the supply of power from the battery 2A to the motor 3 based on detection results from the push switch 24C, trigger switch 22B, as well as a sensor switch 73 and a microswitch 83 described later.

The magazine 7 is provided on the bottom of the sub-body 23, extending in the front-to-rear direction. The motor 3 has a rotational shaft 31 whose axis is oriented in the front-to-rear direction.

The drive-reducing mechanism 4 is disposed on the front side of the motor 3 and is primarily configured of the planetary gear mechanism 41 and final gear 42. The planetary gear mechanism 41 is provided on the front end of the rotational shaft 31 and is mounted in the through-hole 25*a* and held by the gear holder 25. The planetary gear mechanism 41 is a well-known mechanism that includes a sun gear mounted on the rotational shaft 31, a planetary gear, and an output gear 41A. The output gear 41A of the planetary gear mechanism 41 is disposed coaxially with the rotational shaft 31. The planetary gear mechanism 41 is also provided with a one-way clutch (not shown). The one-way clutch allows the output gear 41A to rotate in a direction driven by the rotational force of the motor 3, but restricts rotation of the output gear 41A in the opposite direction.

Figure 2:
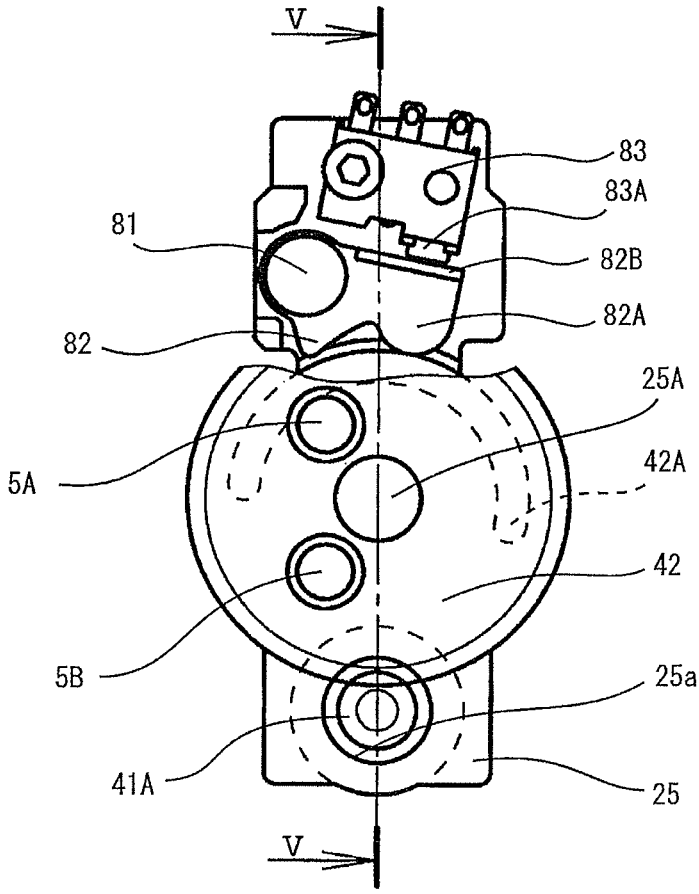
FIG. 2 shows a final gear and an angular position detecting mechanism according to the embodiment of the present invention.
Figure 5:
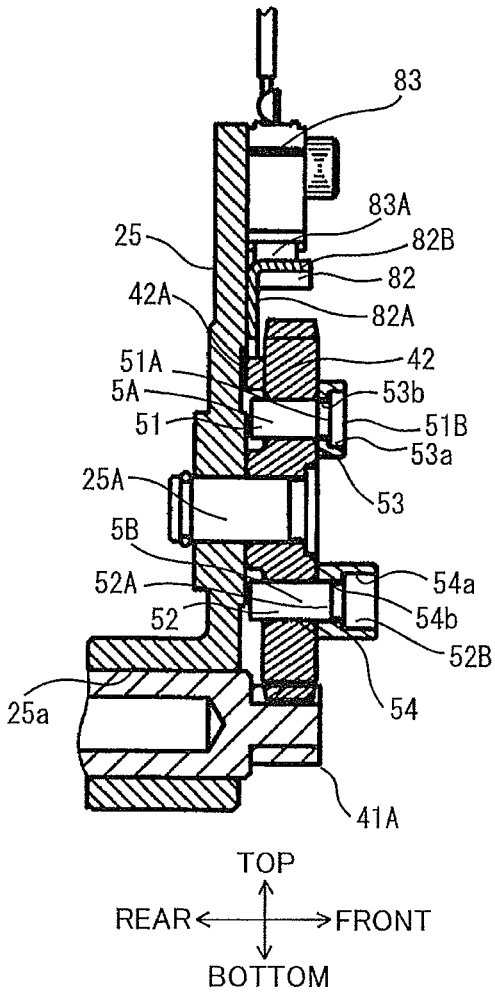
FIG. 5 is a cross-sectional view of the final gear and the angular position detecting mechanism taken along the line V-V in FIG. 2.

The final gear 42 is engaged with the output gear 41A and is rotatably supported on the supporting shaft 25A. As shown in FIG. 5, a distance between the rear endface of the final gear 42 and the front surface of the gear holder 25 is set slightly larger than the plate thickness of a switch lever 82 described later. As shown in FIGS. 1 and 2, a protrusion 42A is provided on the rear endface of the final gear 42 for contacting the switch lever 82. The protrusion 42A has an arc shape that follows the circumferential direction of the final gear 42, covering about 180 degrees of the same. The protrusion 42A protrudes from the rear endface of the final gear 42 a distance slightly greater than the thickness of the switch lever 82 described later.

The compression mechanism 5 is configured of a first engaging part 5A and a second engaging part 5B that protrude forward from the front endface of the final gear 42. As shown in FIG. 2, the first engaging part 5A and second engaging part 5B are disposed on the front surface of the final gear 42 at an interval of about 120 degrees along a circle centered on the axis of the supporting shaft 25A. In FIG. 2, the first engaging part 5A is positioned ahead of the second engaging part 5B in the clockwise direction.

As shown in FIG. 5, the first engaging part 5A is configured of a first pin 51 and a first roller 53, while the second engaging part 5B is configured of a second pin 52 and a second roller 54 having substantially equivalent respective diameters to the first pin 51 and first roller 53. However, the second pin 52 and second roller 54 are slightly longer in the front-to-rear direction than the first pin 51 and first roller 53. That is, the second pin 52 and second roller 54 protrude farther forward than the first pin 51 and first roller 53. The first roller 53 and second roller 54 are configured to contact with the plunger 63.

The first pin 51 is configured of a substantially columnar first base 51A extending out from the front surface of the final gear 42; and a substantially columnar first flange 51B having a larger diameter than the first base 51A and being disposed on the front side of the first base 51A for rotatably supporting the first roller 53. The first roller 53 is formed in an annular shape with a first hole 53*a* and a second hole 53*b* penetrating the first roller 53 in the front-to-rear direction. The first roller 53 is rotatably mounted on the first pin 51. The diameter of the first hole 53*a* is substantially equivalent to that of the first flange 51B so that the inner peripheral surface of the first hole 53*a* slides over the outer circumferential surface of the first flange 51B. The diameter of the second hole 53*b* is set smaller than the diameter of the first flange 51B and larger than the first base 51A, with the first base 51A inserted into the second hole 53*b*. Since the outer periphery of the first flange 51B is larger than the second hole 53*b*, the first roller 53 is restricted from coming off the first pin 51. Further, the depth at which the first hole 53*a* penetrates the first roller 53 is substantially equivalent to the front-to-rear dimension of the first flange 51B. Consequently, the front ends of the first flange 51B and the first roller 53 are flush with each other.

Similarly to the first pin 51 described above, the second pin 52 is provided with a second base 52A and a second flange 52B. As with the first roller 53, the second roller 54 is also annular in shape, with a first hole 54*a* and a second hole 54*b* and is slidably and rotatably supported on the second flange 52B. Since the second engaging part 5B protrudes farther forward than the first engaging part 5A, the front-to-rear dimension of the second flange 52B is set greater than that of the first flange 51B. Thus, the penetrating depth of the first hole 54*a* in the second roller 54 is set larger than that of the first hole 53*a* in the first roller 53 to match the front-to-rear dimension of the second flange 52B. Consequently, the area of contact between the second roller 54 and the second flange 52B is greater than the area of contact between the first roller 53 and first flange 51B.

As shown in FIG. 1, the coil spring unit 6 primarily includes a shaft 61, the coil spring 62, the plunger 63, a bumper 64, a bumper holder 65, and the adjuster 66, all of which components are configured as a single integrated unit. The shaft 61 is cylindrical in shape and has a flange part 61A disposed on the top end, and a position-restricting part 61B on the bottom end. The position of the coil spring unit 6 is accurately established in the housing 2 by inserting and fixing the position-restricting part 61B in the lower penetrating hole 21*b* and inserting and fixing the flange part 61A in the upper recess portion 21*c*, thereby restraining the shaft 61 from shifting relative to the housing 2 during use. A groove is formed circumferentially around the bottom end of the shaft 61 at a position near the position-restricting part 61B. A C-shaped retaining ring 61C is mounted in this groove. The coil spring 62, plunger 63, bumper 64, and adjuster 66 are mounted on the shaft 61 at positions above the retaining ring 61C.

The coil spring 62 is configured of a steel wire wound in a spiral shape, and the shaft 61 is inserted through the spiral-shaped coil spring 62. A pair of washers 62B are mounted over the shaft 61 on the upper side of the coil spring 62, and an elastic member 62A such as a ring-shaped member formed of resin or the like is interposed between the pair of washers 62B. The inner diameter of the washers 62B is smaller than the outer diameter of the flange part 61A. With this configuration, the pair of washers 62B and the elastic member 62A restrict upward movement of the top end of the coil spring 62.

A pair of washers and an elastic member having a similar configuration to the washers 62B and the elastic member 62A are disposed on the bottom side of the coil spring 62. The washers and elastic members disposed above and below the coil spring 62 function to absorb surging in the coil spring 62.

Figure 6A:
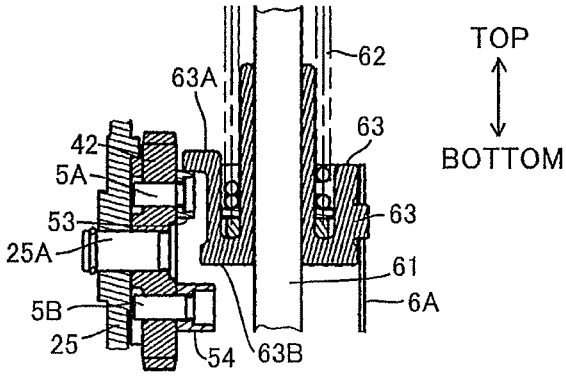
FIG. 6A is a cross-sectional view of a plunger provided in nail-driving tool according to the embodiment from one side thereof.
Figure 6B:
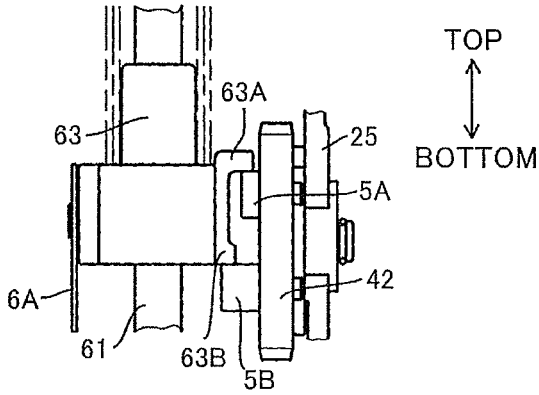
FIG. 6B is a view of a plunger provided in the nail-driving tool according to the embodiment from the opposite side thereof.

A through-hole 63*a* extending vertically is formed in the plunger 63. The shaft 61 is inserted into the through-hole 63*a* so that the plunger 63 is mounted on the shaft 61 at a position below the coil spring 62 and is capable of moving up and down. Since the pair of washers and the elastic member are disposed on the bottom side of the coil spring 62, the coil spring 62 contacts the plunger 63 via the washers and elastic member. As shown in FIGS. 6A and 6B, a first lifting protrusion 63A and a second lifting protrusion 63B juxtaposed vertically are provided on the rear surface of the plunger 63, and a protrusion 63C is provided on the front surface of the plunger 63.

The first lifting protrusion 63A protrudes rearward from the top end of the plunger 63 a distance sufficient to engage the first engaging part 5A. The second lifting protrusion 63B protrudes rearward from the bottom end of the plunger 63 a distance sufficient to engage the second engaging part 5B but not engage the first engaging part 5A.

The driver blade 6A is mounted on the protrusion 63C. The driver blade 6A has a narrow elongated plate shape. A hole 6*a* is formed in the upper end of the driver blade 6A. The driver blade 6A is coupled to the plunger 63 by inserting the protrusion 63C into the hole 6*a*, enabling the driver blade 6A to move up and down within the ejection hole 21*a*, as shown in FIG. 1. The initial state of the driver blade 6A is set such that the distal end (tip) protrudes out from the bottom end of the nose part 21A. Since the cover plate (not shown) is provided on the front side of the driver blade 6A in the ejection hole 21*a*, the driver blade 6A is restricted from moving forward, thus preventing the driver blade 6A from falling out of the protrusion 63C.

The bumper 64 is formed of a soft rubber or a synthetic resin, such as urethane. The bumper 64 is disposed below the plunger 63 and is configured to contact with the plunger 63.

Figure 7:
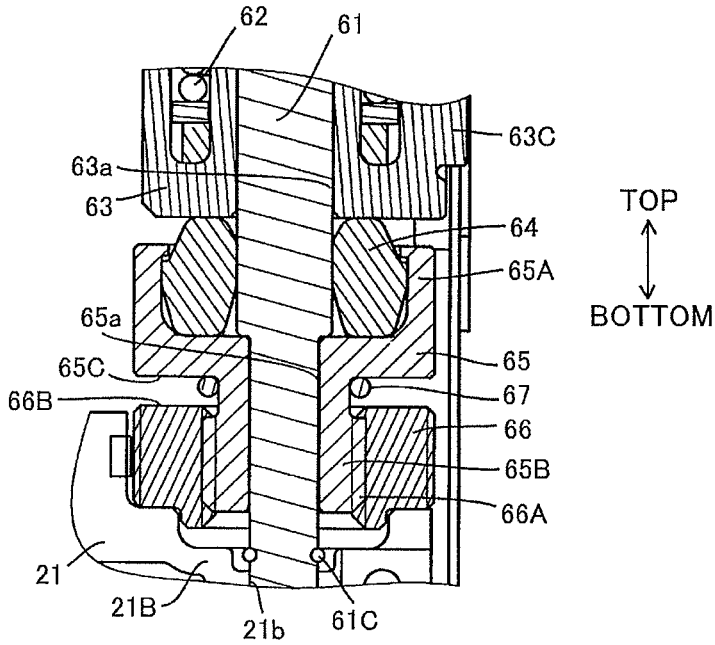
FIG. 7 is an enlarged view of the bumper holder in the nail-driving tool according to the embodiment.

As shown in FIG. 7, the bumper holder 65 includes a bumper receiving part 65A having a receiving surface for receiving the bumper 64, a male threaded part 65B positioned on the opposite side of the bumper 64 with respect to the receiving surface of the bumper receiving part 65A and extending downward from the bottom surface of the bumper receiving part 65A, and a holder-side surface 65C constituting the bottom surface of the bumper receiving part 65A that is orthogonal to the vertical. A through-hole 65*a* is formed in the bumper holder 65 so as to penetrate the bumper receiving part 65A and male threaded part 65B vertically. The shaft 61 is inserted through the through-hole 65*a* so that the bumper holder 65 is mounted on the shaft 61 and is capable of moving vertically relative to the shaft 61. The bumper holder 65 also holds the bumper 64.

Figure 4B:
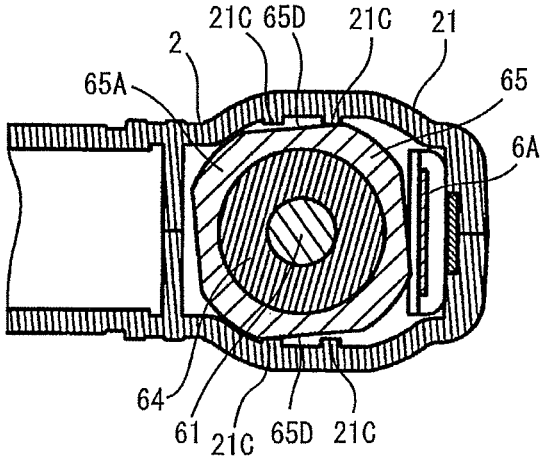
FIG. 4B is a cross-sectional view of the bumper holder in FIG. 4A after the bumper holder has been rotated slightly clockwise.
Figure 4C:
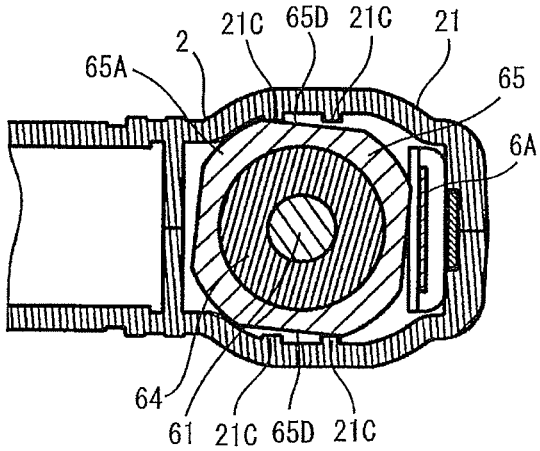
FIG. 4C is a cross-sectional view of the bumper holder in FIG. 4A after the bumper holder has been rotated slightly counterclockwise.

As shown in FIG. 4A, the outer periphery of the bumper receiving part 65A has been processed to form two opposing surfaces 65D. The bumper holder 65 is disposed in the main body 21 so that the surfaces 65D oppose the rails 21C formed on both inner side walls of the main body 21. The distance between one surface 65D and the other surface 65D is slightly shorter than the distance between the rails 21C on one inner side wall of the main body 21 and the rails 21C on the other inner side wall. Thus, the bumper holder 65 can move up and down inside the main body 21 smoothly with only a slight amount of play. The amount of play between the main body 21 and bumper holder 65 is small enough that the bumper holder 65 cannot rotate 180 degrees in the main body 21 about its center axis, for example, but is sufficient to allow the bumper holder 65 to rotate over a small fixed rotational angle of approximately 10 degrees, as illustrated in FIGS. 4B and 4C.

As shown in FIG. 7, the male threaded part 65B is formed according to the same specifications as an M12 screw. Further, the diameter of the through-hole 65*a* formed in the bumper holder 65 is smaller than the outer diameter of the retaining ring 61C mounted on the shaft 61.

The adjuster 66 is substantially cylindrical in shape and is supported in the housing 2 so as to be capable of rotating about its center axis. The adjuster 66 is positioned coaxially with the male threaded part 65B. A female threaded part 66A is provided on the inner peripheral portion of the adjuster 66 and is threadingly engaged with the male threaded part 65B. By rotating the adjuster 66, it is possible to move the male threaded part 65B upward or downward together with the bumper 64. The bumper 64 and bumper holder 65 can move within a range of approximately 2 mm vertically.

The top surface of the adjuster 66 opposite the holder-side surface 65C is a threaded-part-side surface 66B, while the bottom surface is in contact with the receiving part 21B of the main body 21. As shown in FIG. 3, a peripheral portion of the adjuster 66 is exposed outside the housing 2 through the opening 21*d*. A plurality of grooves 66*a* extending in the axial direction of the adjuster 66 is formed along the entire outer circumferential surface of the adjuster 66. The protruding portion 21F is constantly in contact with the outer circumferential surface of the adjuster 66 by the elastic force of the urging member 21E itself, enabling the protruding portion 21F to engage in the grooves 66*a* and thereby preventing unexpected rotation of the adjuster 66. The entire outer circumferential surface of the adjuster 66 is plated with nickel plating or another material that does not wear when the protruding portion 21F slides over this peripheral surface. Nickel plating has a high degree of hardness and is resistant to wear and conducive to sliding.

Since the adjuster 66 is in contact with the receiving part 21B of the main body 21, as described above, the bumper holder 65 threadingly engaged with the adjuster 66 moves upward relative to the housing 2 when the adjuster 66 is rotated to move the bumper holder 65 upward relative to itself. Further, since both ends of the shaft 61 are fixed to the housing 2, as described earlier, the bumper holder 65 moves upward relative to the shaft 61 when moving upward relative to the housing 2. The bumper 64 provided above the bumper holder 65 is configured to contact with the plunger 63 and, thus, defines the lower dead center of the plunger 63. Further, since the driver blade 6A is mounted on the plunger 63, the user can modify the position of the driver blade 6A at its lower dead center, i.e., the depth at which the driver blade 6A drives a fastener, by rotating the adjuster 66.

As shown in FIG. 7, an O-ring 67 is mounted on the bumper holder 65 between the holder-side surface 65C and the threaded-part-side surface 66B. The O-ring 67 is formed of rubber or another elastic material and is coated with grease for preventing wear. The O-ring 67 is an example of an elastic member.

As described above, the retaining ring 61C mounted on the shaft 61 prevents the coil spring 62, plunger 63, bumper 64, bumper holder 65, adjuster 66, and O-ring 67 from coming off the shaft 61. By configuring the above parts 61 through 67 as a single integrated unit in this way, the coil spring 62, plunger 63, bumper 64, bumper holder 65, adjuster 66, and O-ring 67 are simultaneously mounted in the housing 2 when the shaft 61 is mounted and fixed in the housing 2 by inserting the ends of the shaft 61 into the lower penetrating hole 21*b* and upper recess portion 21*c*.

As shown in FIG. 1, the magazine 7 is disposed beneath the sub-body 23 and primarily includes a holder 71, a pusher 72, and a sensor switch 73. The holder 71 retains a plurality of staples 1A arranged in a row. The front end of the holder 71 is positioned in the ejection hole 21*a* on the rear side of the blade guide 26. The staples 1A are sequentially supplied to this position in the ejection hole 21*a* on the rear side of the blade guide 26 by the pusher 72 described next.

The pusher 72 is mounted in the holder 71 and positioned on the rear side of the staples 1A. A spring (not shown) urges the pusher 72 in a forward direction for supplying the staples 1A sequentially into the ejection hole 21*a*. A contact piece 72A provided on the rear end of the pusher 72 is capable of contacting the sensor switch 73.

The sensor switch 73 is disposed in the sub-body 23 at a position above the holder 71. The sensor switch 73 contacts the contact piece 72A when the pusher 72 moves to a prescribed position (for example, a position at which only one staple 1A remains).

As shown in FIGS. 2 and 5, the angular position detecting mechanism 8 includes a lever pin 81, a switch lever 82, and a microswitch 83. The lever pin 81 is mounted on the front surface of the gear holder 25 above the final gear 42, with its axis extending in the front-to-rear direction. The switch lever 82 is rotatably supported on the lever pin 81 so as to be capable of moving between a contact position in contact with the protrusion 42A and an initial position not in contact with the protrusion 42A. As shown in FIG. 5, the switch lever 82 is formed of a metal plate that is thinner than the protruding length of the protrusion 42A and is bent into a shape having a substantially L-shaped cross section. The L-shaped cross section of the switch lever 82 is defined by a protrusion-contacting part 82A forming the portion of the plate extending orthogonal to the front-to-rear direction, and a switch-contacting part 82B that forms the portion of the plate extending in the front-to-rear direction.

The protrusion-contacting part 82A is disposed in the gap between the gear holder 25 and final gear 42 and is capable of contacting the protrusion 42A. Since the gap formed between the gear holder 25 and final gear 42 is just slightly larger than the plate thickness of the protrusion-contacting part 82A, the protrusion-contacting part 82A is restricted from sliding off the protrusion 42A. Further, the outer edge of the protrusion-contacting part 82A is curved, as shown in FIG. 2, with the curved edge positioned to contact the protrusion 42A.

As shown in FIG. 5, the switch-contacting part 82B opposes the outer circumferential surface of the final gear 42 along a radial direction to the final gear 42.

The microswitch 83 is positioned above the switch-contacting part 82B. The microswitch 83 has a switch 83A that is pushed in by the switch-contacting part 82B when the switch lever 82 moves into the contact position. Since the switch 83A is urged outward by a spring (not shown), the switch 83A returns to its initial protruding position when contact between the switch lever 82 and protrusion 42A is lost and the switch lever 82 returns to its initial position.

When operating the nail-driving tool 1 having the construction described above, the user rotates the adjuster 66 to adjust the driving depth of the staple 1A based on the type of workpiece material. Specifically, the user of the nail-driving tool 1 rotates the adjuster 66 with a finger or thumb placed over the peripheral portion of the adjuster 66 that is exposed in the opening 21*d*. That is, the peripheral portion of the adjuster 66 serves as an operating part for rotating the adjuster 66. In order to increase the driving depth, the user rotates the adjuster 66 in a direction for moving the bumper 64 in the driving direction. In order to reduce the driving depth, the user rotates the adjuster 66 in a direction for raising the bumper 64.

Since a peripheral portion of the adjuster 66 is exposed outside the housing 2, the user can easily rotate the adjuster 66 by pushing a finger over the surface of the adjuster 66 in which the grooves 66*a* are formed. Further, since the protruding portion 21F engages in the grooves 66*a* formed in the peripheral surface of the adjuster 66, the adjuster 66 does not rotate in a smooth continuous motion, but produces a clicking sensation as the user rotates the adjuster 66.

Further, the bumper 64 is disposed above the adjuster 66 and is supported in the bumper holder 65 having the male threaded part 65B, and the adjuster 66 having a substantially cylindrical shape covers the male threaded part 65B. Accordingly, since the adjuster 66 and bumper holder 65 are coupled together by threadingly engaging the female threaded part 66A and the male threaded part 65B, the outer diameter of the adjuster 66 can be increased. Therefore, the user of the nail-driving tool 1 can rotate the adjuster 66 using a relatively small force.

After adjusting the driving depth for the staple 1A, the user places the tip of the nose part 21A in contact with the workpiece. By so doing, the push lever 24 is retracted into the housing 2, causing the arm part 24B to contact the push switch 24C and turn the push switch 24C on. While the push switch 24C is on, the user pulls the trigger 22A, turning the trigger switch 22B on. When the power supply regulator 2B detects an ON signal from the push switch 24C and an ON signal from the trigger switch 22B, the power supply regulator 2B begins supplying power to drive the motor 3.

The drive of the motor 3 rotates the rotational shaft 31, while the planetary gear mechanism 41 reduces the rotational speed of the rotational shaft 31 to drive the output gear 41A at a slower speed. The output gear 41A in turn rotates the final gear 42 so that, first, the first engaging part 5A engages the first lifting protrusion 63A (see FIG. 6A), moving the plunger 63 upward. As the final gear 42 continues to rotate and the plunger 63 continues to move upward, the second engaging part 5B engages the second lifting protrusion 63B (see FIG. 6B) and moves the plunger 63 farther upward. When the second engaging part 5B engages the second lifting protrusion 63B and begins to moves the plunger 63 farther upward, the first lifting protrusion 63A separates from the first engaging part 5A.

As the plunger 63 moves upward, elastic energy accumulates in the coil spring 62 by which the coil spring 62 applies an urging force to the plunger 63. When the final gear 42 rotates farther from this state, the second engaging part 5B moving in a circular motion separates from the second lifting protrusion 63B. When this separation occurs, the plunger 63 moves rapidly downward, and the driver blade 6A strikes the staple 1A, driving the staple 1A into the workpiece.

While the driver blade 6A is driving the staple 1A, the plunger 63 collides with the bumper 64. Since this impact is transferred to the adjuster 66 along the axial direction of the same, a strong impact is not applied to the urging member 21E having the protruding portion 21F that contacts the peripheral surface of the adjuster 66. Thus, this configuration prevents damage to the urging member 21E caused by such impacts. Further, the grooves 66*a* formed in the peripheral surface of the adjuster 66 and the protruding portion 21F that engages in these grooves 66*a* serve as a detent for preventing the unintended rotation of the adjuster 66 during a driving operation when the user is not rotating the adjuster 66.

Further, since the urging member 21E supported on the housing 2 is configured of the leaf spring, the construction of the urging member 21E can be simplified. Furthermore, since the protruding portion 21F is formed by bending a portion of the urging member 21E, the construction of the protruding portion 21F can be simplified. In addition, the plurality of grooves 66*a* extending parallel to one another along the axial direction of the adjuster 66 can prevent the user's finger from slipping over the peripheral surface of the adjuster 66 when rotating the same.

Further, the power supply regulator 2B determines the rotational state of the final gear 42 based on a detection signal received from the microswitch 83 when the switch lever 82 contacts the microswitch 83. Specifically, the protrusion 42A and the second engaging part 5B are arranged so that the separation of the protrusion 42A from the switch lever 82 and the separation of the second engaging part 5B from the second lifting protrusion 63B occur simultaneously. Accordingly, upon occurring these separation, the switch lever 82 moves from the contact position to the initial position, causing the microswitch 83 to output an OFF signal. Since the microswitch 83 outputs an ON signal while the switch lever 82 is in contact with the protrusion 42A, the power supply regulator 2B can halt the supply of power to the motor 3 upon detecting that the ON signal has switched to an OFF signal, thereby preventing the final gear 42 from over-rotating.

When the nail-driving tool 1 begins to run out of staples 1A in the magazine 7, the contact piece 72A of the pusher 72 contacts the sensor switch 73, causing the sensor switch 73 to output an ON signal. When the power supply regulator 2B detects an ON signal from the sensor switch 73, the power supply regulator 2B does not supply power to the motor 3, even upon detecting ON signals from the trigger switch 22B and the push switch 24C, thus preventing the nail-driving tool 1 from shooting blanks when the nail-driving tool 1 runs out of staples 1A.

Figure 8:
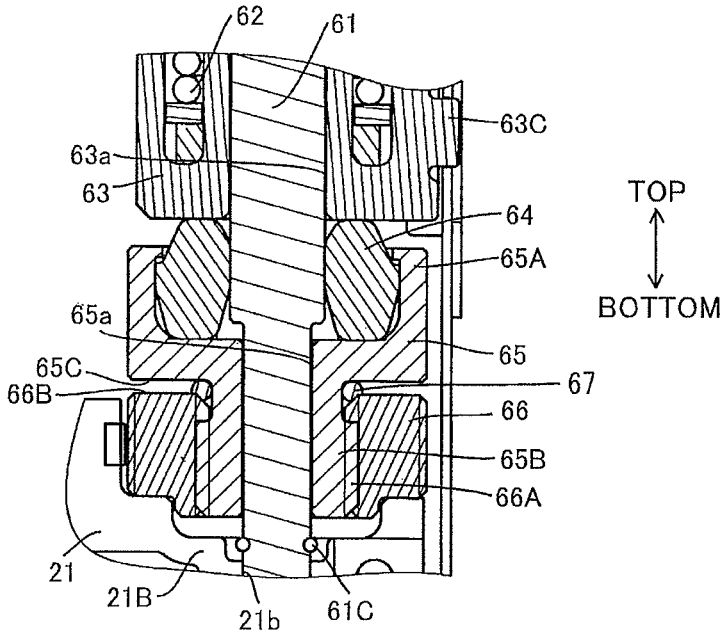
FIG. 8 is an enlarged view of the bumper holder in FIG. 7 when a holder-side surface is in proximity to a threaded-part-side surface.

As shown in FIG. 8, the holder-side surface 65C does not directly contact the threaded-part-side surface 66B when the driving depth for the staple 1A is set to the maximum depth, i.e., when the user rotates the adjuster 66 to move the bumper receiving part 65A of the bumper holder 65 as close as possible to the adjuster 66, because the O-ring 67 is interposed between the holder-side surface 65C and the threaded-part-side surface 66B.

If a staple 1A is driven in this state, the impact of the plunger 63 against the bumper 64 is transferred in a downward direction toward the bumper holder 65. Since the protruding portion 21F restricts rotation of the adjuster 66 in this state, the adjuster 66 does not rotate relative to the housing 2. On the other hand, the bumper holder 65 can rotate slightly relative to the housing 2, as described above. Therefore, the impact of the plunger 63 causes the bumper holder 65 to tighten against the adjuster 66. However, since the O-ring 67 is interposed between the bumper holder 65 and adjuster 66, as described above, the O-ring 67 merely compresses slightly while preventing the holder-side surface 65C from contacting and tightening against the threaded-part-side surface 66B.

Figure 9A:
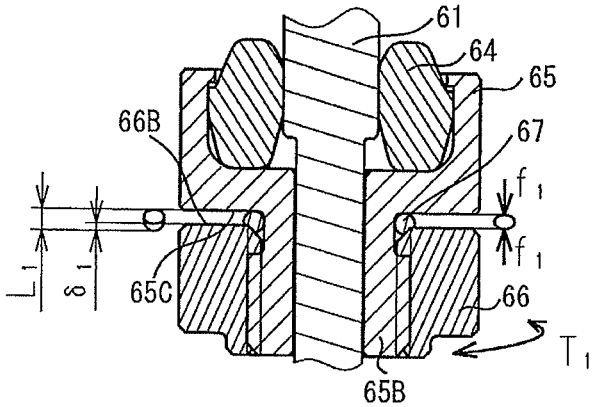
FIGS. 9A and 9B are explanatory diagrams illustrating the tightening effect in the nail-driving tool according to the embodiment.
Figure 9B:
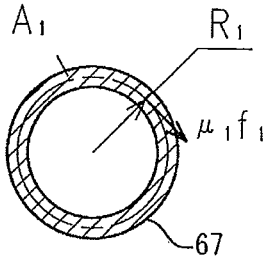

Here, the slight rotation of the bumper holder 65 relative to the adjuster 66 due to tightening, as illustrated in FIGS. 4B and 4C will be explored while comparing cases in which an O-ring 67 is provided and not provided. FIGS. 9A and 9B are explanatory diagrams illustrating the tightening effect in the nail-driving tool 1 according to this embodiment. FIG. 9A is a cross-sectional view of the bumper holder 65 and adjuster 66 taken along the vertical and front-to-rear directions. FIG. 9B is a cross-sectional view of the O-ring 67 taken along a plane orthogonal to the vertical. In this embodiment, the O-ring 67 has a spring constant $k_1$ and a vertical thickness $L_1$. The spring constant $k_1$ of the O-ring 67 is determined by a longitudinal elastic modulus $E_1$ of the base material forming the O-ring 67, a cross-sectional area $A_1$ of the O-ring 67, and the thickness $L_1$. Hence, the spring constant $k_1$ of the O-ring 67 is defined as $k_1=A_1E_1/L_1$. During tightening, the O-ring 67 having the thickness $L_1$ receives a compressive deformation $\delta_1$, generating a deformation load $f_1$ ($=k_1\times\delta_1$) relative to the spring constant $k_1$, as shown in FIG. 9A. Since a frictional force $\mu_1 f_1$ proportional to the deformation load $f_1$ is generated at a point on the contact surface of the O-ring 67 having the radius $R_1$, the torque $T_1$ required to rotate the adjuster 66 in a tightened state is defined as $T_1=\mu_1 f_1\times R_1=\mu_1 k_1\delta_1 R_1$. Here, the radius $R_1$ is the distance along a radial of the O-ring 67 from the center of the O-ring 67 to the cross-sectional center of the O-ring 67.

Figure 10A:
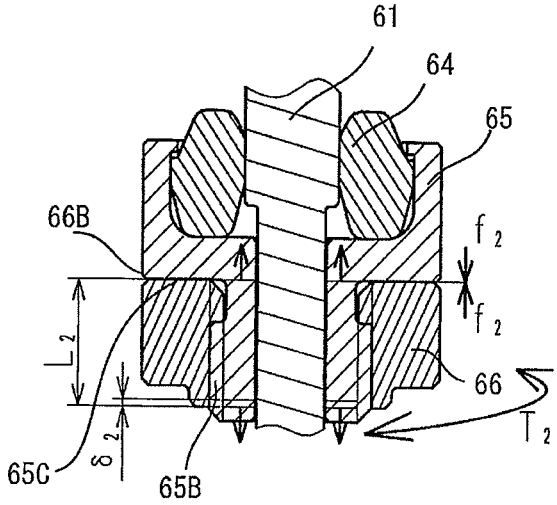
FIGS. 10A and 10B are explanatory diagrams illustrating the tightening effect for a comparative example in which an O-ring is not provided.
Figure 10B:
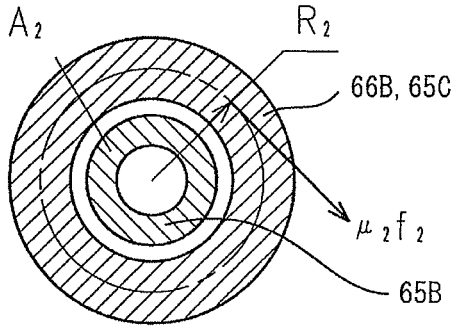

FIGS. 10A and 10B are explanatory diagrams illustrating the tightening effect for a comparative example in which an O-ring is not provided. FIG. 10A is a cross-sectional view of the bumper holder 65 and adjuster 66 along a plane in the vertical and front-to-rear directions. FIG. 10B is a cross-sectional view showing the area of contact between the holder-side surface 65C and threaded-part-side surface 66B and the male threaded part 65B. In this example, the male threaded part 65B has a spring constant $k_2$ and a vertical length $L_2$. The spring constant $k_2$ of the male threaded part 65B is defined by a longitudinal elastic modulus $E_2$ of the adjuster 66, a cross-sectional area $A_2$ of the male threaded part 65B, and the length $L_2$. Hence, the spring constant $k_2$ of male threaded part 65B is defined as $k_2=A_2E_2/L_2$. During tightening, the male threaded part 65B having the length $L_2$ receives a compressive deformation $\delta_2$, generating a deformation load $f_2$ ($=k_2\times\delta_2$) proportional to the spring constant $k_2$. Since a frictional force $\mu_2 f_2$ proportional to the deformation load $f_2$ is produced at a position on the contact surface of the adjuster 66 having the radius $R_2$, the torque $T_2$ required for rotating the adjuster 66 in a tightened state is defined as torque $T_2=\mu_2 f_2\times R_2=\mu_2 k_2\delta_2 R_2$. Here, the radius $R_2$ is the distance along a radial direction from the center of the holder-side surface 65C and threaded-part-side surface 66B to the center of the contact area between the holder-side surface 65C and threaded-part-side surface 66B in the radial direction.

When comparing actual values based on the above definitions, the O-ring 67 and the male threaded part 65B of the adjuster 66 have respective spring coefficients of $k_1=181$ N/mm and $k_2=1280\times10^3$ N/mm, and respective frictional coefficients of $\mu_1=0.2$ and $\mu_2=0.2$. The amount of displacement in the bumper holder 65 of this embodiment is $\delta_1$=0.05 mm and $\delta_2$=0.05 mm, respectively, while the radius for the two examples is $R_1$=5.75 mm and $R_2$=7.5 mm, respectively. Based on these values, the torque in the example of this embodiment is $T_1$=10.4 Nmm, while the torque in the comparative example is $T_2$=96,000 Nmm. Thus, in the comparative example the user would not be above to rotate the adjuster 66.

The amount of torque that an user normally inputs into the adjuster 66 was found to be 140 Nmm through measurements. Therefore, assuming that the maximum torque an user can input is three times this measured value of 140 Nmm, or 420 Nmm, then the distance that the bumper holder 65 is displaced (i.e., the amount that the O-ring 67 compresses) when the adjuster 66 is rotated at the maximum torque of 420 Nmm is 0.8 mm. Thus, the bumper holder 65 and adjuster 66 will not contact each other, even when the above displacement of 0.05 mm is added. Further, this amount of displacement falls within the elastic deformation range of the O-ring 67. In other words, the adjuster 66 (threaded member) and the bumper holder 65 will not become fixed together, even when the user turns the adjuster with great force.

Further, the increase in torque of the adjuster 66 is 10.4 Nmm in this embodiment and 96,000 Nmm in the comparative example. Hence, the change in torque occurring over the same rotational angle is reduced to about $1/1000^{th}$ in this embodiment.

Therefore, in the nail-driving tool 1 according to this embodiment, the frictional force generated between the bumper holder 65 and adjuster 66 via the O-ring 67 is less than that generated when the bumper holder 65 and adjuster 66 directly contact each other. Accordingly, torque in the adjuster 66 relative to the bumper holder 65 is less likely to increase, preventing a decline in operability when tightening occurs.

Further, by configuring the O-ring 67 in a shape and of a material capable of keeping the displacement related to tightening within the elastic deformation range of the O-ring 67, the torque does not change excessively when the adjuster 66 is tightened, improving overall ease of use.

While the fastener-driving tool of the invention has been described in detail with reference to specific embodiments thereof, it would be apparent to those skilled in the art that many modifications and variations may be made therein without departing from the spirit of the invention, the scope of which is defined by the attached claims.

For example, while the urging member 21E of this embodiment is configured of the leaf spring, this embodiment is not limited to the leaf spring. Further, the protruding portion 21F of this embodiment is formed by bending a portion of the urging member 21E. However, the protruding portion 21F is not limited to this construction. The grooves 66*a* are formed in the peripheral surface of the adjuster 66 as a plurality of recessed portions. However, the recessed portions are also not limited to the grooves 66 of this embodiment.

Further, while the grooves 66*a* are formed in the peripheral surface of the adjuster 66 and the protruding portion 21F is formed on the urging member 21E, it is also possible to provide a plurality of protrusion portions on the peripheral surface of the adjuster 66 and to form an recessed portion in the urging member 21E. Here, the protruding portions formed on the peripheral surface of the adjuster 66 may be configured of steel balls, for example.

While the fastener-driving tool of the present invention is a nail-driving tool in this embodiment, the present invention is not limited to a nail-driving tool, but may also be applied to a fastener-driving tool used to drive screws or the like.

What is claimed is:

1. A fastener-driving tool comprising:

a housing;

a shaft disposed in the housing;

a plunger surrounding the shaft and movable in an axial direction of the shaft;

a blade connected to the plunger and movable together with the plunger to impact a fastener;

a bumper and a bumper holder surrounding the shaft and arranged such that the plunger collides with the bumper when the blade impacts the fastener;

an adjuster having a cylindrical shape and threadingly engaged with the bumper holder to move the bumper holder in the axial direction by rotating the adjuster, the adjuster having an outer circumferential surface provided with one of a first recessed portion and a first protruding portion extending in the axial direction; and an urging member fixed to the housing and protruding in a direction perpendicular to the axial direction of the shaft, the urging member having one of a second recessed portion and a second protruding portion, wherein one of the second recessed portion and the second protruding portion is engaged with one of the first protruding portion and the first recessed portion.

2. The fastener-driving tool according to claim 1, wherein the urging member is configured of a leaf spring provided on the housing.

3. The fastener-driving tool according to claim 2, wherein the second protruding portion is formed by bending a portion of the urging member.

4. The fastener-driving tool according to claim 1, wherein the first recessed portion includes a plurality of grooves formed on the outer circumferential surface of the adjuster and extending in the axial direction of the shaft.

5. The fastener-driving tool according to claim 1, wherein the bumper holder is provided with a first threaded part extending in the axial direction, and wherein the adjuster has a through hole, an inner peripheral surface of the through hole being provided with a second threaded part threadingly engaged with the first threading part.

6. A fastener-driving tool comprising:

a housing;

a shaft disposed in the housing;

a plunger surrounding the shaft and movable in an axial direction of the shaft;

a blade connected to the plunger and movable together with the plunger to impact a fastener;

a bumper disposed to overlap with the plunger in the one direction, the plunger configured to collide with the bumper when the blade impacts the fastener;

a bumper and a bumper holder surrounding the shaft and arranged such that the plunger collides with the bumper when the blade impacts the fastener, the bumper holder having a receiving surface for receiving the bumper and a first surface positioned on an opposite side of the receiving surface from the bumper, the bumper holder being provided with a first threaded part positioned on the opposite side of the receiving surface from the bummer;

an adjuster of cylindrical shape having a second surface opposed to the first surface and second threaded part threadingly engaged with the first threaded part to move the bumper holder in the axial direction by rotating the adjuster; and a ring member disposed around the shaft and between the first surface of the bumper holder and the second surface of the adjuster.

7. The fastener-driving tool according to claim 6, wherein the bumper holder is supported on the shaft and rotatable around the shaft within a fixed amount of rotational angle.

8. The fastener-driving tool according to claim 6, wherein the adjuster has an operating part for rotating thereof, and wherein the housing is formed with an opening through which the operating part of the adjuster is exposed.

9. The fastener-driving tool according to claim 6, wherein the ring member has a first spring coefficient for a deformation in the axial direction, and wherein the first threaded part has a second spring coefficient for a deformation in the axial direction, the first coefficient being smaller than the second spring coefficient.

10. The fastener-driving tool according to claim 6, wherein a deformation of the ring member is within an elastic deformation range thereof when the adjuster receives a rotational torque by rotating the adjuster such that the first surface approaches the second surface.

11. The fastener-driving tool according to claim 6, wherein the first threaded part is configured of a male thread and extends in the axial direction from the first surface, and wherein the second threaded part is configured of a female thread and threadingly engaged with the second threaded part.

* * * * *